US008157019B2

(12) United States Patent
King et al.

(10) Patent No.: US 8,157,019 B2
(45) Date of Patent: Apr. 17, 2012

(54) DOWNHOLE SWELLABLE SEALING SYSTEM AND METHOD

(75) Inventors: James G. King, Kingwood, TX (US); Stephen J. Chauffe, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 12/412,490

(22) Filed: Mar. 27, 2009

(65) Prior Publication Data

US 2010/0243276 A1 Sep. 30, 2010

(51) Int. Cl.
*E21B 33/12* (2006.01)

(52) U.S. Cl. ..... 166/387; 166/118

(58) Field of Classification Search ..... 166/179, 166/118, 387

See application file for complete search history.

(56) References Cited

U.S. PATENT DOCUMENTS

| | | | | |
|---|---|---|---|---|
| 2,945,541 | A | 7/1960 | Maly et al. | |
| 3,385,367 | A | 5/1968 | Kollsman | |
| 3,464,090 | A | 9/1969 | Cantarutti | |
| 3,952,799 | A | 4/1976 | Simpson | |
| 4,137,970 | A | 2/1979 | Laflin et al. | |
| 4,612,985 | A * | 9/1986 | Rubbo et al. | 166/114 |
| 4,936,386 | A | 6/1990 | Colangelo | |
| 5,109,926 | A | 5/1992 | Mody et al. | |
| 5,195,583 | A | 3/1993 | Toon et al. | |
| 6,343,791 | B1 | 2/2002 | Anyan et al. | |
| 6,581,682 | B1 | 6/2003 | Parent et al. | |
| 6,659,178 | B2 | 12/2003 | Wilson et al. | |
| 7,059,415 | B2 | 6/2006 | Bosma et al. | |
| 7,228,915 | B2 | 6/2007 | Thomson | |
| 7,284,603 | B2 | 10/2007 | Ohmer | |
| 7,303,023 | B2 | 12/2007 | Harrall et al. | |
| 7,304,098 | B2 | 12/2007 | Li et al. | |
| 7,387,158 | B2 * | 6/2008 | Murray et al. | 166/196 |
| 2005/0199401 | A1 * | 9/2005 | Patel et al. | 166/387 |
| 2007/0144733 | A1 * | 6/2007 | Murray et al. | 166/179 |
| 2007/0163777 | A1 * | 7/2007 | Murray et al. | 166/179 |
| 2008/0087441 | A1 | 4/2008 | Wood et al. | |
| 2009/0038796 | A1 | 2/2009 | King | |

FOREIGN PATENT DOCUMENTS

| | | |
|---|---|---|
| EP | 1 672 166 | 11/2007 |
| WO | 2008014095 | 1/2008 |

OTHER PUBLICATIONS

Innes, Gareth, et al. "Next Generation Expandable Completion Systems," in: SPE Technical Symposium of Saudi Arabia Section, May 21-23, 2006, Dhahran, Saudi Arabia. DOI: 10.2118/106342-MS.

(Continued)

*Primary Examiner* — Giovanna Wright
*Assistant Examiner* — Blake Michener
(74) *Attorney, Agent, or Firm* — Cantor Colburn LLP

(57) ABSTRACT

Disclosed herein is a downhole tubular sealing system. The system includes, a tubular runnable in a downhole wellbore, a swellable seal disposed at the tubular that is sealable with the downhole wellbore when swelled, and at least one releasable member in operable communication with the tubular and the swellable seal. The at least one releasable member configured to longitudinally fix the swellable seal to the tubular when nonreleased and to longitudinally disengage the swellable seal from the tubular when released.

17 Claims, 3 Drawing Sheets

OTHER PUBLICATIONS

Maddox, Brad, et al. "Cementless Multi-Zone Horizontal Completion Yields Three-Fold Increase," in: IADC/SPE Drilling Conference, Mar. 4-6, 2008, Orlando, Florida, USA. DOI 10.2118/112774-MS.

Ostvik, Egil, et al. "Increasing Production with an Innovative Through Flow Line (TFL) Multi-Zone Completion Design for a Major Norwegian Operator," in: SPE Annual Technical Conference and Exhibition, Sep. 30-Oct. 3, 2001, New Orleans Louisiana. DOI: 10.2118/71666-MS.

Plauche, Rick, et al. "Advances in Sliding Sleeve TEchnology and Coiled Tubing Performance Enhance Multizone Completion of Abnormally Pressure Gulf of Mexico Horizontal Well," in SPE/ICoTA North American Coiled Tubing Toundtable, Apr. 1-3, 1997, Montgomery, Texas. DOI: 10.2118/38403-MS.

Rogers, Hank, et al. "New Equipment Designs Enable Swellable Technology in Cementless Completions," in: IADC/SPE Drilling Conference, Mar. 4-6, 2008, Orland Florids, USA. DOI: 10.2118/112302-MS.

Welling, Rudy, et al. "Inflor Profile Control in Horizontal Wells in a Fractured Carbonate Using Swellable Elastomers," SPE Middle East Oil and Gas Show and Conference, Mar. 11-14, 2007, Kingdom of Bahrain. DOI: 10.2118/105709-MS.

Baker Oil Tools, Product Information: Seal Assemblies, pp. 124-134, Feb. 2003.

* cited by examiner

DOWNHOLE SWELLABLE SEALING SYSTEM AND METHOD

BACKGROUND

It is common in multi-stage completions in downhole hydrocarbon wells to sealingly engage a wellbore at multiple locations to allow individualized stimulation treatment of each of the separate stages. The casing from surface and between each of the separated stages undergoes longitudinal expansion and contraction due to temperature changes of the casing. An example of when such temperature changes may occur is during stimulation treatment when fluid pumped downhole is a much lower temperature than the prevailing downhole temperatures. The longitudinal expansions and contractions can stress the casing, the seals and walls of the wellbore causing damage to one or more systems of the well operation. Systems and methods to prevent such damage are well received in the art.

BRIEF DESCRIPTION

Disclosed herein is a downhole tubular sealing system. The system includes, a tubular runnable in a downhole wellbore, a swellable seal disposed at the tubular that is sealable with the downhole wellbore when swelled, and at least one releasable member in operable communication with the tubular and the swellable seal. The at least one releasable member configured to longitudinally fix the swellable seal to the tubular when nonreleased and to longitudinally disengage the swellable seal from the tubular when released.

Further disclosed herein is a method of sealing a tubular to a downhole structure. The method includes, positioning the tubular with a swellable seal disposed thereat within a downhole wellbore, swelling the swellable seal into sealing engagement with the downhole structure, longitudinally unfixing the swellable seal from the tubular, and slidably sealingly engaging the swellable seal with the tubular

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

A downhole tubular sealing system disclosed herein allows a swellable seal initially longitudinally fixed to a tubular to be positioned within a downhole wellbore. Once downhole, the swellable seal can be swelled into sealing engagement with walls of the wellbore. Release members that initially longitudinally fix the swellable seal to the tubular can be released, thereby allowing the swellable seal to remain in sealing engagement with the wellbore walls while also allowing the tubular to longitudinally move in relation to the swellable seal while maintaining sealing integrity with the swellable seal.

Figure 1:
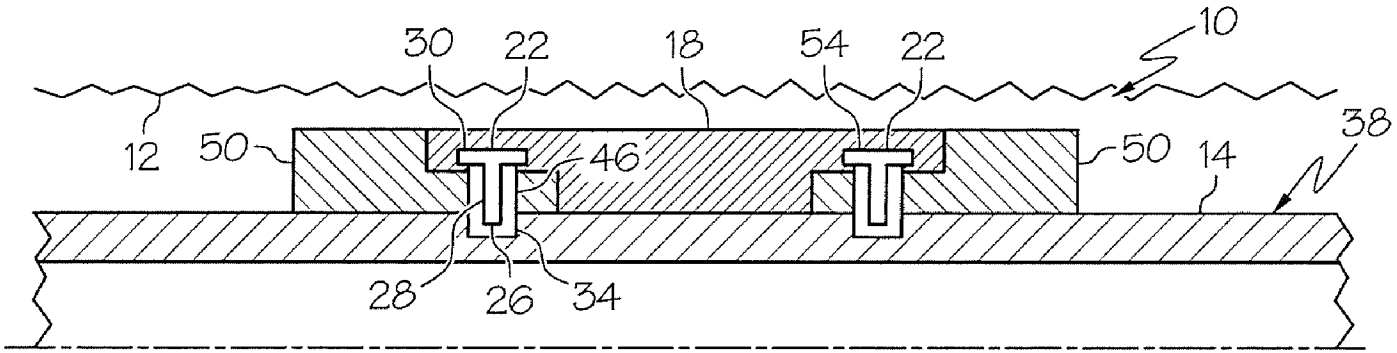
FIG. 1 depicts a quarter cross sectional view of a sealing system disclosed herein in a non-sealed configuration.

Referring to FIG. 1, an embodiment of a downhole tubular sealing system 10 disclosed herein is illustrated within a downhole wellbore 12. The sealing system 10 includes, a tubular 14, illustrated in this embodiment as a casing, a swellable seal 18 and at least one releasable member 22 (two being shown) longitudinally fixing the swellable seal 18 to the tubular 14. In this view the sealing system 10 is shown positioned within the wellbore 12 in a run-in configuration and as such is not in sealing engagement with the wellbore 12 as the swellable seal 18 is in an unswelled condition.

Each of the releasable members 22 has a point end 26, a shaft 28, and a head end 30. The point ends 26 engage with recesses 34 in an outer surface 38 of the tubular 14 while the shafts 28 slidable engage with through holes 42 (more easily seen in FIG. 2) in the swellable seal 18 and through holes 46 in dams 50. The releasable members 22 thereby longitudinally fix the swellable seal 18 to the dams 50 and the tubular 14 in response to the point ends 26 being engaged with the recesses 34, as is the case when the releasable members 22 are in the nonreleased configuration. The head ends 30 of each releasable members 22 is encased in the swellable seal 18 such that some of the swellable material of the swellable seal 18 is positioned between broad flanges 54 of the head ends 30 and portions 58 of the dams 50 (more easily seen in FIG. 2) that include the holes 46. With this configuration, swelling of the swellable seal 18 causes the releasable members 22 to move radially outwardly as a thickness of a portion of the swellable seal 18 between the flange 54 and the dam 50 increases. Sizing of the components are set so that the point ends 26 of the releasable members 22 withdraw from the recesses 34 prior to the swellable seal 18 reaching its full swell dimensions, thereby assuring release of the releasable members 22 in response to swelling of the swellable seals 18.

Figure 2:
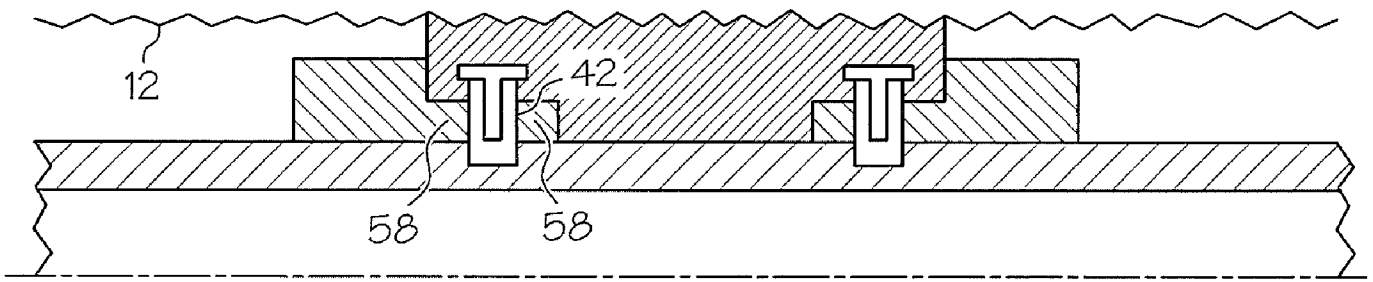
FIG. 2 depicts a quarter cross sectional view of the sealing system of FIG. 1 with the seal sealingly engaged with a downhole wellbore.

FIG. 2 illustrates the swellable seal 18 in a swelled condition. In this condition the swellable seal 18 is sealingly engaged with the wellbore 12. Additionally, the releasable members 22 are shown in a released configuration so that the swellable seal 18 can sealingly slide along the tubular 14. The swellable seal 18 in this view has not been longitudinally displaced from the run-in position along the tubular 14, and therefore the point ends 26 are still longitudinally aligned with the recesses 34.

Figure 3:
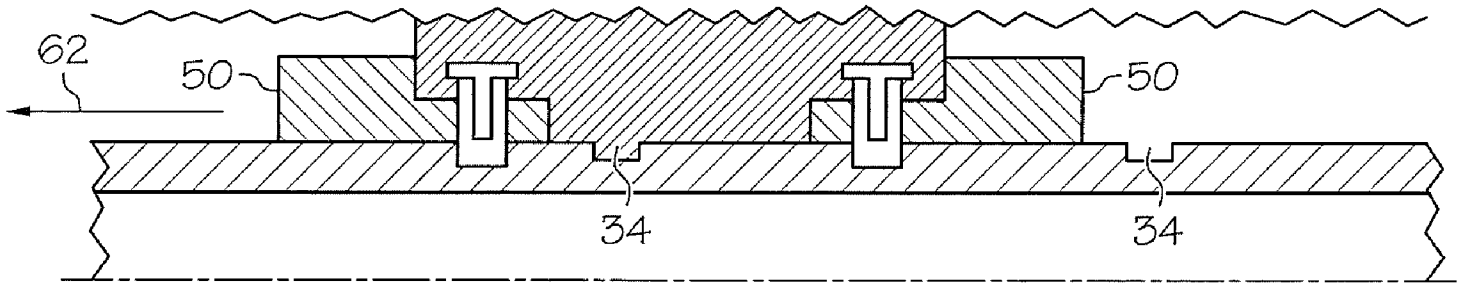
FIG. 3 depicts a quarter cross section view of the sealing system of FIG. 1 with releasable members in a released and translated configuration.

In FIG. 3, the swellable seal 18 is still swollen and in sealing engagement with the wellbore 12 and the releasable members 22 are in a released configuration. Additionally, the swellable seal 18, the releasable members 22 and the dams 50 have been longitudinally displaced along the tubular 14 in the direction of arrow 62. The swellable seal 18 remains sealingly engaged with the tubular 14 during the longitudinal displacement.

Figure 4:
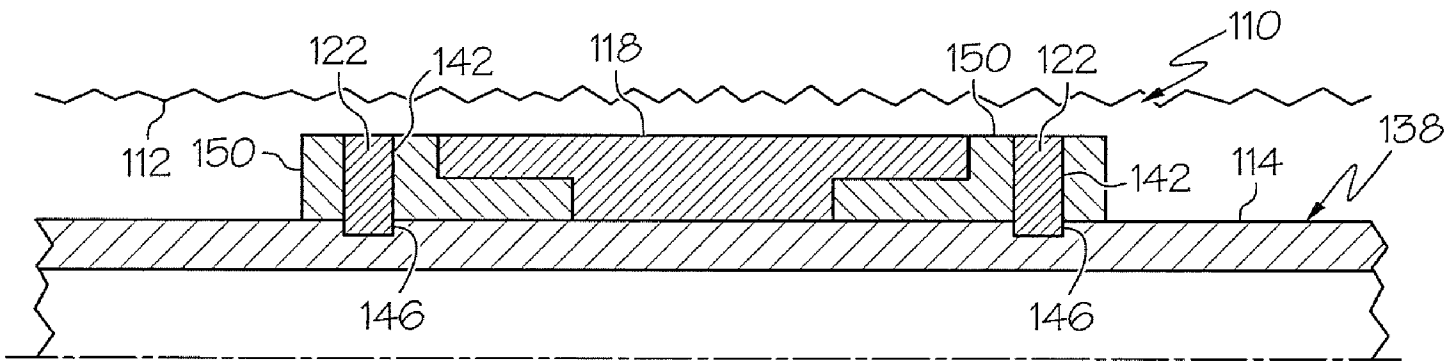
FIG. 4 depicts a quarter cross sectional view of an alternate sealing system disclosed herein in a non-sealed configuration.
Figure 5:
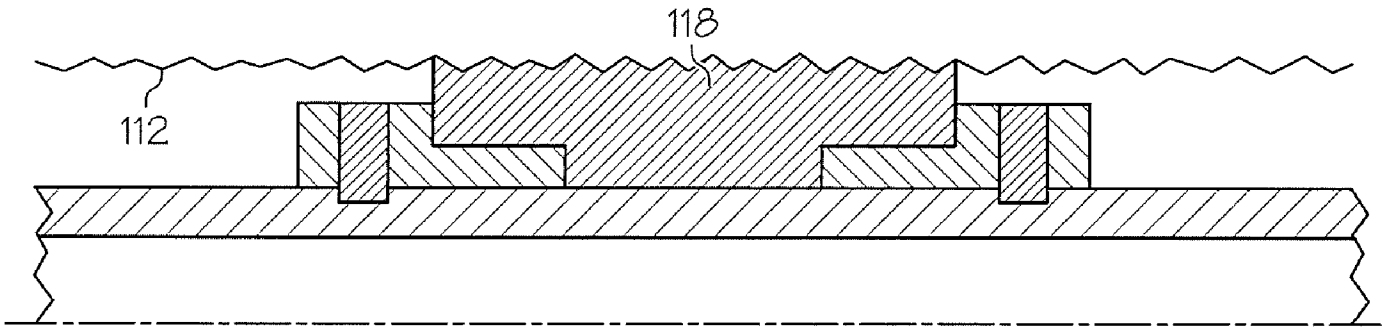
FIG. 5 depicts a quarter cross sectional view of the sealing system of FIG. 4 with the seal sealingly engaged with a downhole wellbore.
Figure 6:
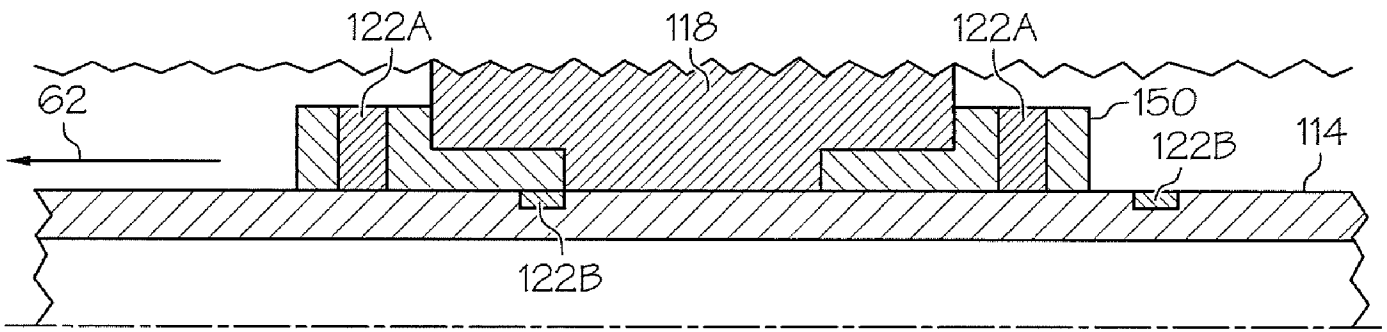
FIG. 6 depicts a quarter cross sectional view of the sealing system of FIG. 4 with releasable members in a released and translated configuration.

Referring to FIGS. 4-6, an alternate embodiment of a downhole tubular sealing system 110 disclosed herein is illustrated. Unlike in the system 10 in the system 110 the releasable members 122 do not release in response to swelling of the swellable seal 118. Instead, the releasable members 122 are force failing members such as, shear screws or lock rings, for example, with shear screws being illustrated in this figure.

The releasable members 122 longitudinally fix the dams 150 directly to the tubular 114 until a large enough longitudinal force between the dams 150 and the tubular 114 shears the screws 122. These longitudinal forces may be generated by contraction or expansion of the tubular 114 due to temperature changes thereof while the swellable seal 118 is swelled and sealingly engaged with the wellbore 112. The swellable seal 118 is contained on the tubular 114 between the dams 150.

In FIGS. 4 and 5 the shear screws 122 are shown intact and threadably engaged in at least holes 142 in the dams 150 and holes 146 in surface 138 of the tubular 114. In FIG. 4 the swellable seal 118 is unswelled, and in FIG. 5 the swellable seal 118 is swelled and sealingly engaged with the wellbore 112.

Referring to FIG. 6, the shear screws 122 have been sheared such that screw portions 122A are movable with the dams 150, while screw portions 122B are movable with the tubular 114. In alternate embodiments the screw portions 122B may not be connected to the tubular 114, but instead may be free to travel to where ever they happen to go. As illustrated, the swellable seal 118 and dams 150 have been moved longitudinally from their original position along the tubular 114 in a direction according to arrow 162.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A downhole tubular sealing system comprising:

a tubular runnable in a downhole wellbore;

a swellable seal disposed at the tubular being sealable with the downhole wellbore when swelled; and at least one releasable member in operable communication with the tubular and the swellable seal configured to longitudinally fix the swellable seal to the tubular in both longitudinal directions when nonreleased and to longitudinally disengage the swellable seal from the tubular when released the at least one releasable member being configured to release in direct response to swelling of the swellable seal.

2. The downhole tubular sealing system of claim 1, wherein the swellable seal is positioned radially outwardly of the tubular.

3. The downhole tubular sealing system of claim 1, wherein the swellable seal is in sealing engagement with the tubular.

4. The downhole tubular sealing system of claim 3, wherein the sealing engagement with the tubular is slidable in response to the at least one releasable member being in a released configuration.

5. The downhole tubular sealing system of claim 1, wherein the at least one releasable member is a force failing member.

6. The downhole tubular sealing system of claim 5, wherein the force failing member is one of a shear screw, a lock ring and combinations including at least one of the foregoing.

7. The downhole tubular sealing system of claim 5, wherein the force failing member is failable due to a change in a longitudinal position of the tubular.

8. The downhole tubular sealing system of claim 7, wherein the change in the longitudinal position is due to changes in temperature.

9. The downhole tubular sealing system of claim 1, wherein the swellable seal swells in response to exposure to downhole fluid.

10. The downhole tubular sealing system of claim 9, wherein the downhole fluid is selected from the group consisting of water, oil, natural gas or a combination of one or more of the foregoing.

11. A method of sealing a tubular to a downhole structure comprising:

positioning the tubular with a swellable seal disposed thereat within a downhole wellbore;

swelling the swellable seal into sealing engagement with the downhole structure;

disengaging at least one releasable member from engagement with at least one of the tubular and the swellable seal in direct response to swelling of the swellable seal;

longitudinally unfixing in both longitudinal directions the swellable seal from the tubular; and slidably sealingly engaging the swellable seal with the tubular.

12. The method of sealing the tubular to a downhole structure of claim 11, wherein the longitudinally unfixing includes failing at least one force failing member.

13. The method of sealing the tubular to a downhole structure of claim 12, wherein the failing at least one force failing member is in response to longitudinally urging the tubular in relation to the swellable seal.

14. The method of sealing the tubular to a downhole structure of claim 12, wherein the failing is shearing.

15. The method of sealing the tubular to a downhole structure of claim 11, wherein the disengaging includes moving the at least one releasable member in response to swelling of the swellable seal and the moving is radially outwardly.

16. The method of sealing the tubular to a downhole structure of claim 11, wherein the swelling is in response to exposure of the swellable seal to downhole fluid.

17. The method of sealing the tubular to a downhole structure of claim 11, wherein the swelling is in response to changes in temperature of the swellable seal.

* * * * *